US005445320A

United States Patent [19]

Berthelier

[11] Patent Number: 5,445,320

[45] Date of Patent: Aug. 29, 1995

[54] METHOD OF AND EQUIPMENT FOR SNOW PRODUCTION

[75] Inventor: Jean M. F. Berthelier, La Barre, France

[73] Assignee: Technip, Courbevoie, France

[21] Appl. No.: 187,192

[22] Filed: Jan. 25, 1994

[30] Foreign Application Priority Data

Jan. 26, 1993 [FR] France ..... 93 00741

[51] Int. Cl.[6] ..... F25C 3/04; B05B 1/24

[52] U.S. Cl. ..... 239/2.2; 239/14.2; 239/128

[58] Field of Search ..... 239/14.2, 2.2, 128; 62/90, 96; 165/61, 65

[56] References Cited

U.S. PATENT DOCUMENTS

| | | | |
|---|---|---|---|
| 1,717,005 | 6/1929 | Carrier | 62/96 X |
| 1,837,798 | 12/1931 | Shipley | 62/120 |
| 2,291,029 | 7/1942 | Everetts, Jr. | 165/65 X |
| 3,738,117 | 6/1973 | Engel | 62/90 X |
| 3,916,644 | 11/1975 | Nasser | 62/90 X |
| 3,990,260 | 11/1976 | Eustis | 62/89 |
| 4,742,958 | 5/1988 | Bucceri | 239/2.2 |
| 4,767,054 | 8/1988 | Suga et al. | 239/14.2 |
| 4,768,711 | 9/1988 | Suga | 239/14.2 |
| 4,792,093 | 12/1988 | Suga et al. | 239/14.2 |
| 4,798,331 | 1/1989 | Suga | 239/2.2 X |
| 4,889,180 | 12/1989 | Sloan | 239/128 X |
| 5,289,973 | 3/1994 | French | 239/2.2 X |

FOREIGN PATENT DOCUMENTS

| | | | |
|---|---|---|---|
| 0004803 | 10/1979 | European Pat. Off. . | |
| 541867 | 5/1993 | European Pat. Off. | 239/2.2 |
| 747508 | 6/1933 | France . | |
| 889830 | 10/1943 | France . | |
| 1372024 | 8/1964 | France . | |
| 2609327 | 7/1988 | France . | |
| 3315236 | 10/1984 | Germany | 165/65 |
| 220384 | 3/1985 | Germany | 62/90 |
| 234757 | 9/1989 | Japan | 165/65 |
| 53017 | 11/1922 | Sweden | 62/90 |
| 141819 | 11/1930 | Switzerland | 62/90 |
| 2221024 | 1/1990 | United Kingdom . | |
| 9010183 | 9/1990 | WIPO . | |

*Primary Examiner*—Andres Kashnikow
*Assistant Examiner*—Lesley D. Morris
*Attorney, Agent, or Firm*—Steinberg, Raskin & Davidson

[57] ABSTRACT

A method of and equipment for producing snow in a closed circuit, including blowing air with a turbine into a tunnel having an air cooling member, a member for the relative reheating of the air, one or several snow guns and a snow depositing chamber, the method and equipment being usable for testing the behavior of materials in a snowy atmosphere.

17 Claims, 1 Drawing Sheet

METHOD OF AND EQUIPMENT FOR SNOW PRODUCTION

Figure 1:
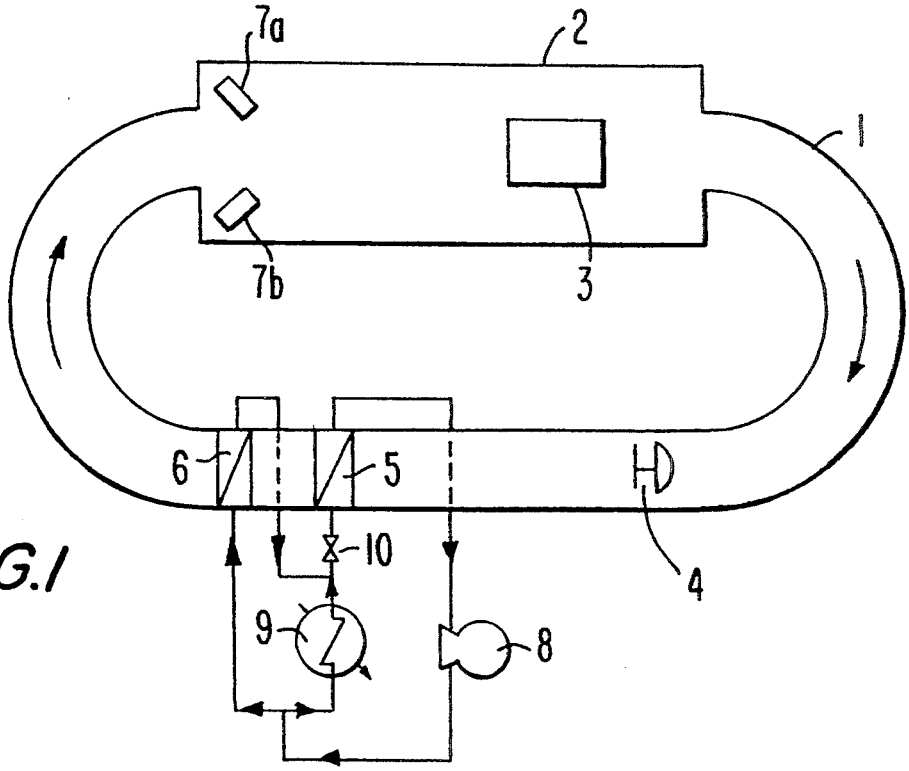

The present invention relates to a method of and equipment for the production of snow in an essentially confined medium or environment, i.e. isolated at least in part and preferably fully from the natural outside atmosphere.

The problem of the production of snow in a medium isolated from the atmosphere arises in particular for industrial and experimental purposes. It indeed is desirable to be able to study the behavior of various materials subjected to severe climatic conditions and in particular to the snow. Now while such tests may sometimes be carried out outside under particularly cold climates, this does not hold true when the outside temperature is above zero degree centigrade or when the required conditions, for instance snow and wind at the same time, are not obtained or properly controlled. It also is not possible to choose the quality of the manufactured (moist or dry) snow.

There has already been proposed to provide apparatus for the production of snow in a confined medium or environment in particular to study the behavior of automotive vehicles facing bad weather and their consequences in particular the penetration of snow through openings such as the ventilation or air-conditioning inlets or louvers, the deposit of snow upon the cooling system in particular upon the radiator, thermal shocks on some parts normally raised to a high temperature, loss of grip on the ground, abrasion effect upon the paint and other fragile portions of the vehicle.

An apparatus for the production of snow of this type is disclosed for instance in the U.S. Pat. No. 4,798,331. This equipment in the shape of a loop or circuit essentially closed upon itself successively comprises a zone of blowing a gaseous fluid, for example air, drawn in from the zone of collection or deposit of snow referred to hereinafter, a zone of cooling of the blown gaseous fluid, to lower its temperature below 0° C., a zone of injection of water, for instance as fine droplets, into the blown gaseous fluid and a zone of collecting or depositing the formed snow, the zones communicating with each other in the order of previous listing, which also is the direction of circulation or flow of the gaseous fluid. The resulting gaseous fluid, freed at least in pat from the snow which has deposited itself in the zone of collection, is taken up again at least in part to flow back through being sucked in, to the zone of blowing.

According to the embodiment disclosed in the aforesaid prior patent, the air is taken up again upstream of the chamber of deposit of the snow but it could be possible to contemplate to take this air up again at the opposite end of the snow depositing chamber, in particular if the equipment is provided horizontally and not vertically as in the aforesaid patent.

There are indeed known apparatus in particular for testing the behavior of vehicles with respect to snow carried along by the air at a controlled speed, these apparatus comprising in the order of succession of the essential elements of a closed circuit, an air blowing section, a section for cooling the blown air stream to bring its temperature below 0° C., for instance below −2° C. and in particular down to a value between −5° C. and −50° C. or therebeyond, a section of injection of water into the blown and cooled air stream and a section of deposit of the snow carried along by the blown and cooled air stream. The air freed at least in part from the snow is drawn in again at least in part from the deposit section and returns to the blowing section.

The authors of the present invention have found out that this kind of equipment did not allow to perform a satisfactory control of the quality of the snow. In particular if it is desired to have dry snow, the amount of injected water should be substantially reduced, thereby decreasing the snow production; failing that precaution, the snow is moist or wet and sticky or tacky, thereby being not appropriate for some uses of this snow.

Therefore to cope with these inconveniences, the subject of the invention is a method of production of snow in an essentially confined medium or environment, within a snow collection section, which consists in passing a gaseous fluid from the snow collecting section successively through a section for cooling the gaseous fluid to being it temperature down below −2° C., a section for heating the gaseous fluid, the heating being positive but moderate in order that the temperature of the gaseous fluid remains below 0° C. after the heating and a section of injection of water into the gaseous fluid to form the snow gathered or recovered within the snow collecting section, characterized in that at least one part of the thermal energy taken from the gaseous fluid within the cooling section is transferred to the gaseous fluid within the heating section.

The invention relates also to equipment allowing the method referred to hereinabove to be carried out. This equipment successively comprises means for blowing a gaseous fluid, means for cooling down the gaseous fluid, means for heating the gaseous fluid, sprayed water injection means and snow collecting means, the means being connected with each other in the order of the previous listing thereof by ducts permitting the passage of gaseous fluids and arranged to form a continuous circuit closed upon itself.

According to a preferred embodiment, the equipment further comprises means for circulating in a loop a refrigerating fluid successively in the cooling means and the heating means, means for recompressing the refrigerating fluid between the outlet of the cooling means and the inlet of the heating means and means for expanding the refrigerating fluid between the outlet of the heating means and the inlet of the cooling means.

According to another embodiment, the equipment comprises means for circulating in a loop a first heat-carrying fluid successively in the cooling means and in first heat exchange means and means for circulating in a loop a second heat-carrying fluid successively in the heating means and in second heat exchange means and means for passing a refrigerating fluid in a loop successively in the first and second heat exchange means under conditions allowing to take thermal energy from the first heat-carrying fluid and to transfer at least in part this thermal energy to the second heat-carrying fluid.

The invention will be described more in detail hereinafter upon referring to the air which is the preferred gaseous fluid. By way of example if the temperature of the air after having been cooled down is between −5° C. and −50° C., the heating could raise the temperature of he air by at least 2° C. provided that the temperature of the heated air remains below −2° C. and preferably below −4° C. Preferably the air should be cooled down to a temperature T1 between −8° C. and −20° C. and should be heated up by at least 3° C., preferably by at least 5° C. to obtain a temperature T2 higher than T1 and preferably lying between −5° C. and −12° C.

When operating according to the improvement referred to hereinabove, it is possible to obtain non-sticky or little sticky "dry" snow with a greater productivity than according to the known state of prior art.

The equipment may be arranged vertically or obliquely but it is preferable to arrange the various sections referred to hereinabove in a same horizontal plane.

A preferred embodiment consists in arranging an indirect contact cooling exchanger in the cooling section and an indirect contact heating exchanger in the heating section and circulating a vaporizable refrigerating fluid in a closed circuit successively through these two exchangers. Preferably the fluid would evaporate at least in part in the exchanger of the cooling section and would condense at least in part within the exchanger of the heating section, thereby causing the cooling and the heating, respectively, or the air flowing on the opposite face of the exchanger involved. The condensing may be completed when desired in another exchanger arranged in series or in parallel with respect to the exchanger of the heating section and exchanging heat for instance with the atmosphere. The mode of operation preferably is "with a compression", i.e. the refrigerating fluid condensed at least in part at a relatively high pressure in the heating exchanger is expanded and evaporated at least in part at a lower pressure, hence at a relatively low pressure in the cooling exchanger; the resulting vapor is recompressed at least in part and then at least one portion of the resulting compressed vapor flows through the heating exchanger where it is caused to be condensed at least in part.

According to another embodiment the mode of operation is with an absorption using an ammonia circuit for example.

Without desiring to be limited in any way by a theory explaining the advantages obtained, it is believed that the air which has flown through the cooling section is fully or very substantially saturated with steam and is relatively unsuitable for the production of snow other than a moist snow whereas the air which has at first been strongly cooled down and which has given up water as frost in the cooling section and then has been heated up again outside of the aforesaid icing section according to the invention is sub-saturated with steam, thereby making it more apt to the production of "dry" snow and this in a relatively greater amount.

Thus for instance air saturated with steam at −12° C. and then reheated up to −4° C. without any new supply of water is saturated at about 50% only.

According to the invention, it is preferred that the air after having been reheated, be saturated at no more than 20% to 90% and preferably at 30% to 80%.

By way of example while in an equipment of conventional type the air is cooled down to −5° C. before the production of snow, it could according to the invention be at first cooled down for example to −12° C. while giving up frost upon the exchanger and leaving this exchanger while being saturated at nearly 100%. It could then be heated again in the absence of any water supply up to −5° C., thereby lowering its percentage of saturation with steam down for example to 70%.

When performing the preferred process of heat transfer between the cooling and heating exchangers and owing to the savings in energy resulting therefrom, the additional energy consumption due to the initial greater temperature lowering in the invention is rather largely compensated for and therefore remains low with respect to the substantial gain obtained in productivity and/or in the quality of the snow.

The elements of the equipment other than the cooling/heating pair may be of a conventional type and do therefore not require a detailed description. The heat exchangers themselves may be of any kind whatsoever, for instance plate or tubular exchangers.

The water spraying devices are of a conventional type and for instance of the kind known as a "snow gun". The water may be injected alone or in sprayed form into an auxiliary air stream. It is also possible to "seed" with the assistance of small snow or ice crystals according to a known technique.

The velocity of the blown air (or other gas) may be selected at will, for example from 1 to 30 m/s or more, preferably from 5 to 20 m/s; the air may for instance be a homogeneous or pulsed or turbulent jet.

The equipment and this is here one of its many advantages may be easily modified to operate occasionally under conditions outside of the invention, for instance to form a freezing rain or also to operate at temperatures above 0° C. In this latter cause, the exchangers are not used or are on the contrary flown through by a heating fluid.

Although the invention preferably is applicable in the automobile field, the equipment may be used for testing the resistance to snow of materials for packing, clothing, electric lines, water, gas or oil pipelines, this list being not limitating.

By way of exemplary embodiment, the equipment has been used by cooling the air blown at a speed of 10 m/s (circulating in a loop) down to −15° C., by heating it up to −7° C., by injecting a fine fog or mist of sprayed water at +2° C. carried along by an auxiliary air stream at −20° C. under a pressure of 40 bars. One has collected a height of 0.2 m of dry snow in one hour in the snow depositing chamber. The refrigerating equipment operated with R-22 while using a cooling exchanger as an evaporator.

The condensing of the R-22 was performed in part in the heating exchanger and in part in an exchanger with the outside air.

Figure 2:
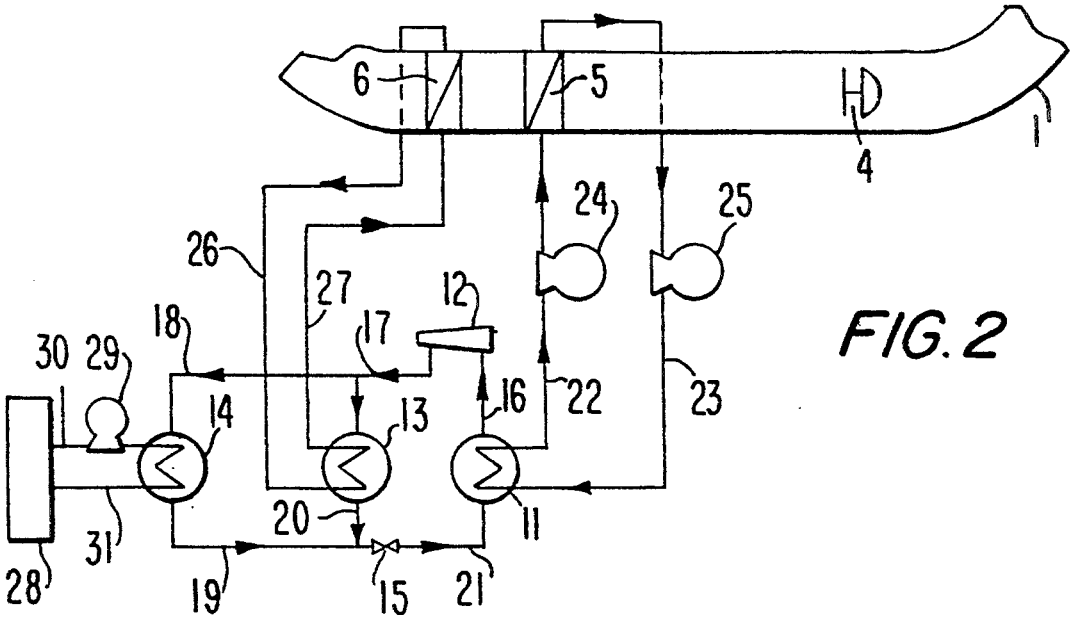

On the accompanying drawings, figures 1 and 2 show two embodiments of the invention.

According to figure 1, the equipment takes the shape of a tunnel in a closed loop 1. The tunnel comprises the snow receiving chamber 2 where has been disposed an automotive vehicle 3 for example, a blowing turbine 4, a bank of air cooling exchangers 5, a bank of heating exchangers 6 and snow guns 7*a* and 7*b*. The thermal equipment comprises a compressor 8 for the fluid vapor issuing from the cooling exchanger 5. The compressed fluid is condensed at least in part within the heating exchanger 6 and for the balance or remainder within the exchanger 9 which is advantageously arranged at the outside and cooled down either with water or with atmospheric air. After having passed into the exchangers 6 and 9, the fluid is in the condensed state. It passes into the expander or pressure-reducer 10 of static or dynamic type to flow into the exchanger 5 where it receives heat from the air pulsed by the ventilation turbine 4 thereby causing the cooling of the air.

On figure 2 only one portion of figure 1 has been taken again, the one which comprises the turbine 4 and the exchangers 5 and 6. The refrigerating circuit is different since the fluid which undergoes the compression- /expansion cycle does not pass into the exchangers 5 and 6; there are used two distinct circuits for an auxiliary heat-conveying fluid of any kind whatsoever, adapted to the selected temperature range for passing into each one of these exchangers, the fluid being not necessarily the same for each one of the circuits. It is not useful that this auxiliary fluid undergoes a change of state; it could therefore remain gaseous and preferably liquid in each one of the circuits.

The coolant proper which undergoes changes of liquid/vapor state, flows through the exchanger 11, the compressor 12, the condensers arranged in parallel 13 and 14 and the expander or pressure-reducer 15 and the ducts connecting these devices, namely 16 to 21. The cooling circuit of the exchanger 5 only comprises the exchangers 5 and 11 and the pipelines 22 and 23 with one or several pumps for example 24 and 25; it is flown through by a first auxiliary heat-carrying fluid. The other auxiliary heat-carrying fluid flows through the condensing exchanger 13 and the heating exchanger 6 as well as the connecting ducts 26 and 27 while passing through one or several pumps (not shown).

Two condensers arranged in parallel 13 and 14 have been shown although the condenser 14 be not fully indispensable for the invention. The heat received in this condenser is transmitted to an auxiliary fluid which rejects it into the cooling tower 28 while passing through the pump 29 and the pipelines 30 and 31.

As examples of auxiliary fluids may be cited the Dowtherm and the Gilotherm 12 (registered trademarks).

It should be understood that the aforesaid equipments may be modified to a large extent without departing from the scope of the invention. Thus the circuit of heat-carrying fluid of figure 1 may comprise the exchangers 6 and 9 arranged in series or use the exchanger 6 only. Likewise, this circuit may comprise several stages or have a cascade configuration. Those skilled in the art of refrigeration will be able to contemplate many obvious modifications. It is also possible to operate with a tunnel 1 arranged in a partially open loop by recycling one portion only of the air and by completing with fresh air.

What is claimed is:

1. In a method of production of snow in a confined space, which method comprises the steps of passing a gaseous fluid from a snow collecting section successively through a section for cooling said gaseous fluid to being its temperature below −2° C., a section for reheating said gaseous fluid, said reheating being conducted such that the temperature of the gaseous fluid remains below 0° C. after said reheating, and a section for injecting water into the gaseous fluid to form the snow collected in the snow collecting section, the improvement comprising the steps of:

transferring a portion of thermal energy taken from the gaseous fluid in the cooling section to the gaseous fluid in the reheating section;

cooling the gaseous fluid in said cooling section to a temperature between about −5° C. and about −50° C.;

heating the gaseous fluid in said reheating section to a temperature that remains below about −2° C. and greater than the temperature to which the gaseous fluid is cooled by at least 2° C.; and wherein the gaseous fluid is air.

2. A method according to claim 1, further comprising the step of providing the the cooling in the cooling section and heating in the reheating section via a vaporizable refrigerating fluid.

3. A method according to claim 2, further comprising the steps of evaporating at least a part of the refrigerating fluid in the cooling section under a relatively low pressure to form a vapor, compressing at least a part of the vapor and conveying at least one part thereof into the reheating section where it condenses under a relatively high pressure to form a condensate, and passing the condensate after expansion thereof to the cooling section.

4. A method according to claim 1, wherein the gaseous fluid is cooled in said cooling section to a temperature between about −8° C. and about −20° C. and the gaseous fluid is heated in said reheating section to a temperature between about −5° C. and about −12° C. and greater than the temperature to which the gaseous fluid is cooled by at least 3° C.

5. A method according to claim 1, further comprising the step of arranging said cooling section, said reheating section and said water injecting section in a common horizontal plane.

6. A method according to claim 1, further comprising the steps of circulating a first heat-carrying fluid for cooling the gaseous fluid in a loop through the cooling section and a first heat exchange section, circulating a second heat-carrying fluid for heating the gaseous fluid in a loop through the reheating section and a second heat exchange section, and passing a refrigerating fluid in a loop through the first heat exchange section and the second heat exchange section whereby the refrigerating fluid receives thermal energy from the first heat-carrying fluid to cool it down and transfers at least a part of the received thermal energy to the second heat-carrying fluid for heating it.

7. A method according to claim 1, further comprising the step of passing a refrigerating fluid in a loop through said cooling section and said reheating section to transfer thermal energy from the gaseous fluid in said cooling section to the gaseous fluid in said reheating section and from the gaseous fluid in said reheating section to the gaseous fluid in said cooling section.

8. An apparatus for producing snow, comprising means for blowing a gaseous fluid, means for cooling down the gaseous fluid, said cooling means having an inlet and an outlet for passage of a fluid therethrough, means for heating the gaseous fluid, said heating means having an inlet and an outlet for passage of a fluid therethrough, means for injecting sprayed water into the gaseous fluid to form snow in snow collecting means, duct means for coupling said blowing means to said cooling means, said cooling means to said heating means, said heating means to said water injecting means, said water injecting means to said snow collecting means and said snow collecting means to said blowing means to form a continuous circuit for passage of the gaseous fluid, means for circulating a refrigerating fluid in a loop through said cooling means and said heating means via respective ones of said inlets and outlets therein, means for compressing said refrigerating fluid between said outlet of said cooling means and said inlet of said heating means, and means for expanding said refrigerating fluid between said outlet of said heating means and said inlet of said cooling means.

9. An apparatus according to claim 8, further comprising means for circulating in a loop a first heat-carrying fluid through said cooling means and first heat exchange means, means for circulating in a loop a second heat-carrying fluid through said heating means and second heat exchange means, and means for passing an additional refrigerating fluid in a loop through said first and second heat exchange means such that thermal energy is transferred from the first heat-carrying fluid to the second heat-carrying fluid.

10. An apparatus according to claim 8, wherein said means for injecting sprayed water comprise a duct section having snow guns arranged therein.

11. In a method for producing snow in a confined space, which method comprises the steps of passing a gaseous fluid from a snow collecting section successively through a section for cooling said gaseous fluid to bring its temperature below −2° C., a section for reheating said gaseous fluid such that the temperature of the gaseous fluid remains below 0° C. after said reheating, and a section for injecting water into the gaseous fluid to form the snow collected in the snow collecting section, the improvement comprising the steps of:

transferring a portion of thermal energy removed from the gaseous fluid in the cooling section to the gaseous fluid in the reheating section;

passing a vaporizable refrigerating fluid through the cooling section and the reheating section to provide respective cooling of the gaseous fluid and heating of the gaseous fluid therein;

evaporating a portion of the refrigerating fluid in the cooling section under a relatively low pressure to form a vapor;

compressing a portion of the vapor and conveying a part thereof into the reheating section where it condenses under a relatively high pressure to form a condensate; and passing the condensate after expansion to the cooling section to reconstitute the refrigerating fluid.

12. A method according to claim 11, further comprising the step of arranging said cooling section, said reheating section and said water injecting section in a common horizontal plane.

13. A method according to claim 11, further comprising the steps of circulating a first heat-carrying fluid for cooling the gaseous fluid in a loop through the cooling section and a first heat exchange section;

circulating a second heat-carrying fluid for reheating the gaseous fluid in a loop through the reheating section and a second heat exchange section; and passing an additional refrigerating fluid in a loop through the first heat exchange section and the second heat exchange section whereby the additional refrigerating fluid receives thermal energy from the first heat-carrying fluid to cool it down and transfers at least a part of the received thermal energy to the second heat-carrying fluid for heating it.

14. In a method for producing snow in a confined space, which method comprises the steps of passing a gaseous fluid from a snow collecting section successively through a section for cooling said gaseous fluid to being its temperature below −2° C., a section for reheating said gaseous fluid, said reheating being conducted such that the temperature of the gaseous fluid remains below 0° C. after said reheating, and a section for injecting water into the gaseous fluid to form the snow collected in the snow collecting section, the improvement comprising the steps of:

transferring a portion of thermal energy removed from the gaseous fluid in the cooling section to the gaseous fluid in the reheating section;

circulating a first heat-carrying fluid for cooling the gaseous fluid in a loop through the cooling section and a first heat exchange section;

circulating a second heat-carrying fluid for reheating the gaseous fluid in a loop through the reheating section and a second heat exchange section; and passing a refrigerating fluid in a loop through the first heat exchange section and the second heat exchange section whereby the additional refrigerating fluid receives thermal energy from the first heat-carrying fluid to cool it down and transfers at least a part of the received thermal energy to the second heat-carrying fluid for heating it.

15. A method according to claim 14, further comprising the step of arranging said cooling section, said reheating section and said water injecting section in a common horizontal plane.

16. An apparatus for producing snow, comprising means for blowing a gaseous fluid, means for cooling down the gaseous fluid, means for heating the gaseous fluid, means for injecting sprayed water into the gaseous fluid to form snow in snow collecting means, duct means for coupling said blowing means to said cooling means, said cooling means to said heating means, said heating means to said water injecting means, said water injecting means to said snow collecting means and said snow collecting means to said blowing means to form a continuous circuit for the passage of the gaseous fluid, first and second heat exchange means, means for circulating in a loop a first heat-carrying fluid through said cooling means and said first heat exchange means, means for circulating in a loop a second heat-carrying fluid through said reheating means and said second heat exchange means, and means or passing an additional refrigerating fluid in a loop through said first and second heat exchange means such that thermal energy is transferred from the first heat-carrying fluid to the second heat-carrying fluid.

17. An apparatus according to claim 16, wherein said means for injecting sprayed water comprise a duct section having snow guns arranged therein.

* * * * *